US010020606B1

(12) United States Patent
Chen

(10) Patent No.: US 10,020,606 B1
(45) Date of Patent: Jul. 10, 2018

(54) INTEGRATED ELECTRICAL CONNECTOR

(71) Applicant: Xiamen GHGM Industrial Trade Co., Ltd., Xiamen (CN)

(72) Inventor: Bingshui Chen, Xiamen (CN)

(73) Assignee: XIAMEN GHGM INDUSTRIAL TRADE CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/681,433

(22) Filed: Aug. 21, 2017

(51) Int. Cl.

| | |
|---|---|
| ***H01R 11/22*** | (2006.01) |
| ***H01R 13/24*** | (2006.01) |
| ***H01R 43/20*** | (2006.01) |
| ***H01R 13/66*** | (2006.01) |
| ***H01R 13/6466*** | (2011.01) |
| ***H01R 12/72*** | (2011.01) |
| *H01R 12/58* | (2011.01) |
| *H01R 13/11* | (2006.01) |

(52) U.S. Cl.
CPC ..... *H01R 13/24* (2013.01); *H01R 12/721* (2013.01); *H01R 13/6466* (2013.01); *H01R 13/665* (2013.01); *H01R 43/205* (2013.01); *H01R 12/58* (2013.01); *H01R 13/112* (2013.01); *H01R 13/113* (2013.01)

(58) Field of Classification Search
None
See application file for complete search history.

(56) References Cited

U.S. PATENT DOCUMENTS

| | | | | |
|---|---|---|---|---|
| 4,380,359 A * | 4/1983 | Hoffman | ..... | H01R 12/7076 439/77 |
| 7,654,874 B2 * | 2/2010 | Ader | ..... | H01H 85/203 439/853 |
| 7,967,649 B2 * | 6/2011 | Richter | ..... | H01R 4/183 174/84 C |
| 9,634,413 B2 * | 4/2017 | Hashiguchi | ..... | H01R 13/11 |

FOREIGN PATENT DOCUMENTS

| | | | | |
|---|---|---|---|---|
| EP | 0913885 A1 * | 5/1999 | ..... | H01R 13/113 |

* cited by examiner

*Primary Examiner* — Tho D Ta
(74) *Attorney, Agent, or Firm* — Leong C. Lei

(57) ABSTRACT

An integrated electrical connector is integrally formed of a sheet and includes a main body. The middle of the main body is formed with an H-shaped cutout portion to divide the main body into a square frame and two elastic pieces. Two first opposing sides of the square frame are disconnected from the elastic pieces and erected upwardly. Inner edges of two second opposing sides of the square frame are connected with lower ends of the two elastic pieces, respectively. Upper ends of the two elastic pieces are inclined upwardly to form an elastic clip having an included angle for insertion of a male terminal. Outer ends of the main body are formed with pins for connection of a PCB board. The structure is simple to provide convenient electrical connection and better reliability.

6 Claims, 4 Drawing Sheets

INTEGRATED ELECTRICAL CONNECTOR

BACKGROUND OF THE INVENTION

Field of the Invention

The present invention relates to an integrated electrical connector.

Description of the Prior Art

In the prior art, there are many kinds of electrical connectors used between a light source board and a driver board of an LED lamp, but the structure of most electrical connectors is complicated, and the effect of the electrical connection is not satisfactory. Accordingly, the inventor of the present invention has devoted himself based on his many years of practical experiences to solve these problems.

SUMMARY OF THE INVENTION

The primary object of the present invention is to provide an integrated electrical connector which has a simple structure to provide convenient electrical connection and better reliability.

In order to achieve the aforesaid object, the integrated electrical connector of the present invention is integrally formed of a sheet and comprises a main body. The middle of the main body is formed with an H-shaped cutout portion to divide the main body into a square frame and two elastic pieces. Two first opposing sides of the square frame are disconnected from the elastic pieces and erected upwardly. Inner edges of two second opposing sides of the square frame are connected with lower ends of the two elastic pieces, respectively. Upper ends of the two elastic pieces are inclined upwardly to form an elastic clip having an included angle for insertion of a male terminal. Outer ends of the main body are formed with pins for connection of a PCB board.

Preferably, the upper ends of the two elastic pieces are close to each other to form a guide hole therebetween. The guide hole is configured for insertion of the male terminal that is a metal needle or a conducting wire having an insulating layer.

Preferably, the upper ends of the two elastic pieces have a gap defined therebetween and are bent reversely to extend upwardly. The gap is configured for insertion of the male terminal that is a PCB gold finger.

Preferably, the two first opposing sides of the square frame are provided with reinforcement ribs, respectively.

Preferably, the two first opposing sides of the square frame have a reverse U shape.

Preferably, outer ends of the two second opposing sides of the square frame of the main body are formed with the pins for connection of the PCB board.

The product of the present invention is integrally formed and has a simple structure and saves the materials and the cost. Two opposing sides of the square frame are erected upward for the two elastic pieces to approach the middle of the square frame to form an elastic clip having an included angle. This way ensures that the male terminal (metal needle, conducting wire, or PCB gold finger) can be inserted well. The reliability of the electrical connection is better.

The height of the integrated electrical connector of the present invention can be designed to be low, and the space in the height direction can be saved to facilitate miniaturization of an LED lamp.

The present invention is applicable to electrical connectors between a light source board and a driver board of an LED lamp and may be applied to the electrical connection between two components of other products.

DETAILED DESCRIPTION OF THE PREFERRED EMBODIMENTS

Embodiments of the present invention will now be described, by way of example only, with reference to the accompanying drawings.

Figure 1:
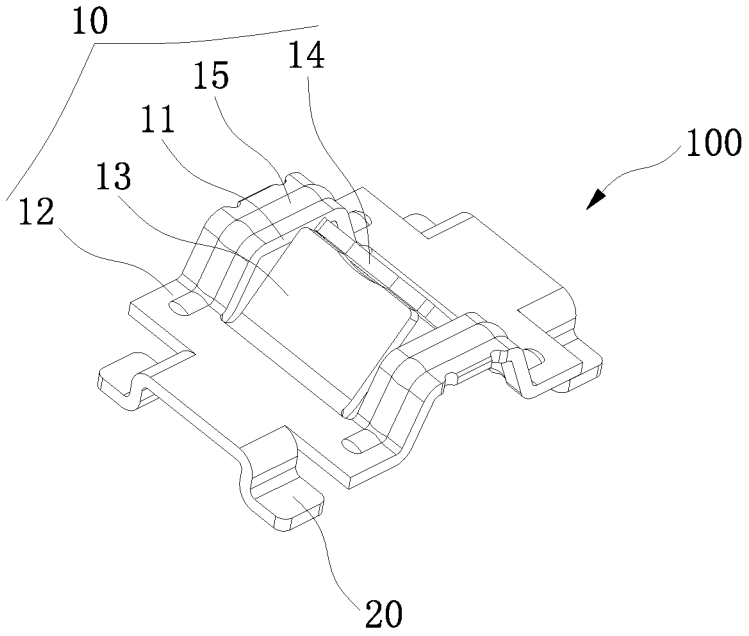
FIG. 1 is a perspective view in accordance with a first embodiment of the present invention.
Figure 2:
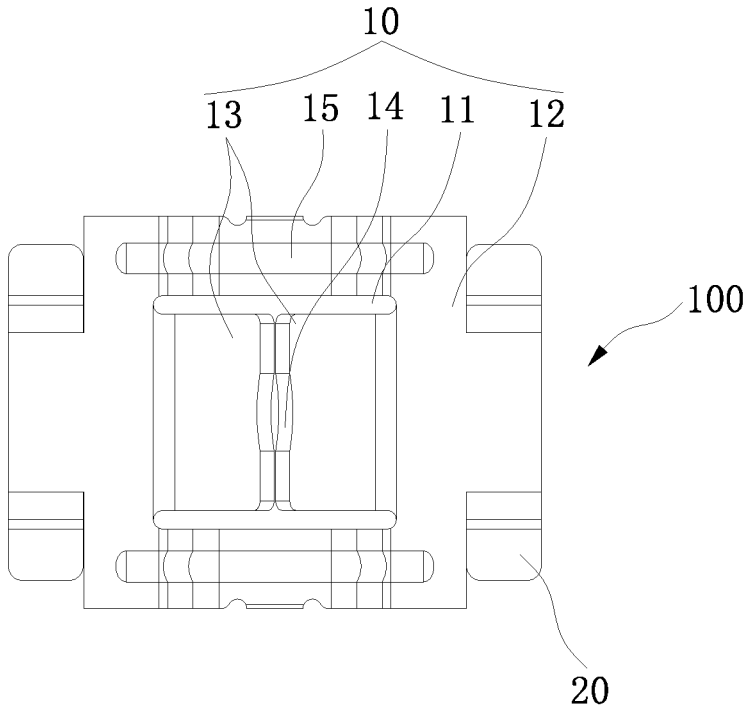
FIG. 2 is a top view in accordance with the first embodiment of the present invention.
Figure 3:
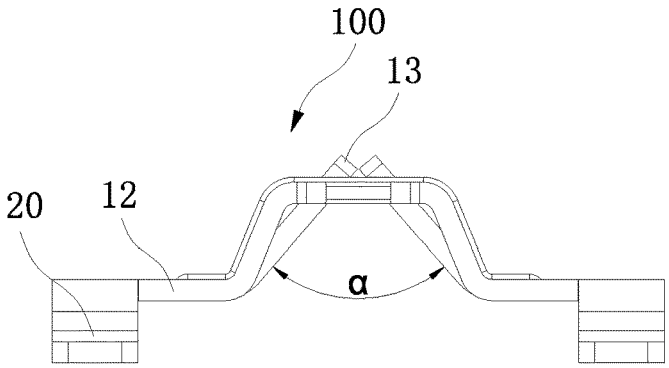
FIG. 3 is a side view in accordance with the first embodiment of the present invention.
Figure 8:
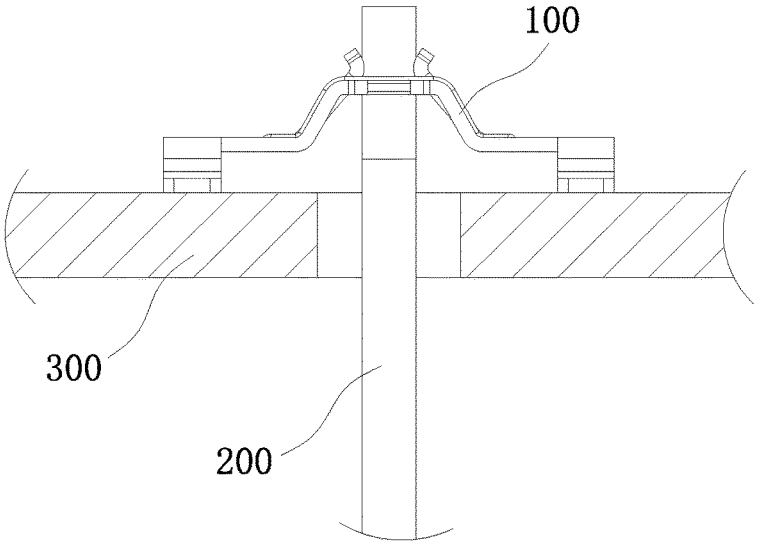
FIG. 8 is a schematic view in accordance with the second embodiment of the present invention in cooperation with a PCB gold finger.

As shown in FIG. 1. 1 to FIG. 8, the present invention discloses an integrated electrical connector 100. The integrated electrical connector 100 is integrally formed of a sheet, and comprises a main body 10 and pins 20.

Figure 4:
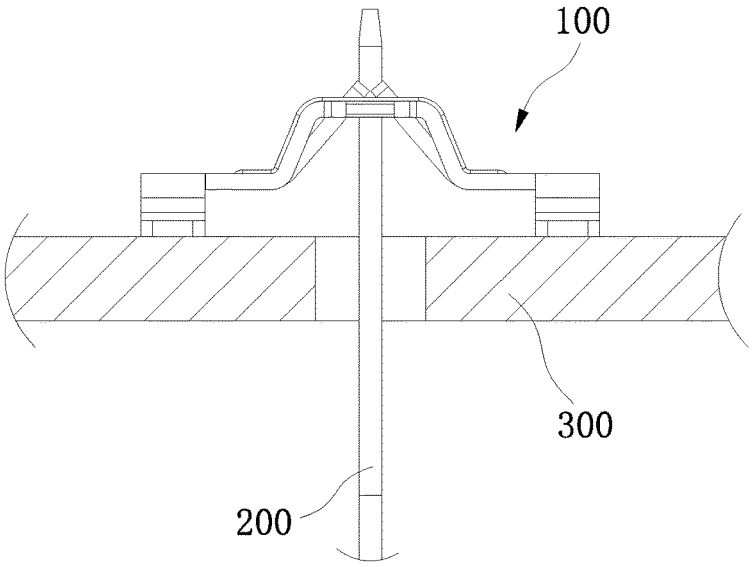
FIG. 4 is a schematic view in accordance with the first embodiment of the present invention in cooperation with a metal needle.
Figure 5:
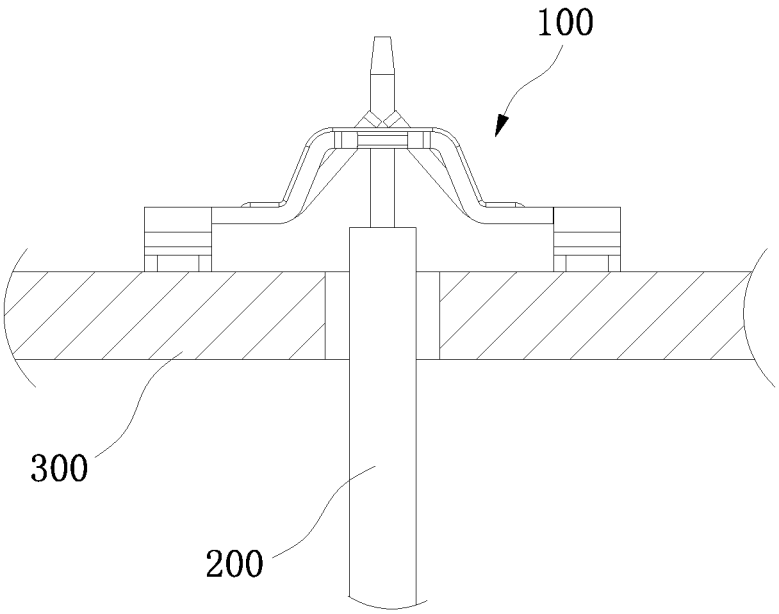
FIG. 5 is a schematic view in accordance with the first embodiment of the present invention in cooperation with a conducting wire.
Figure 6:
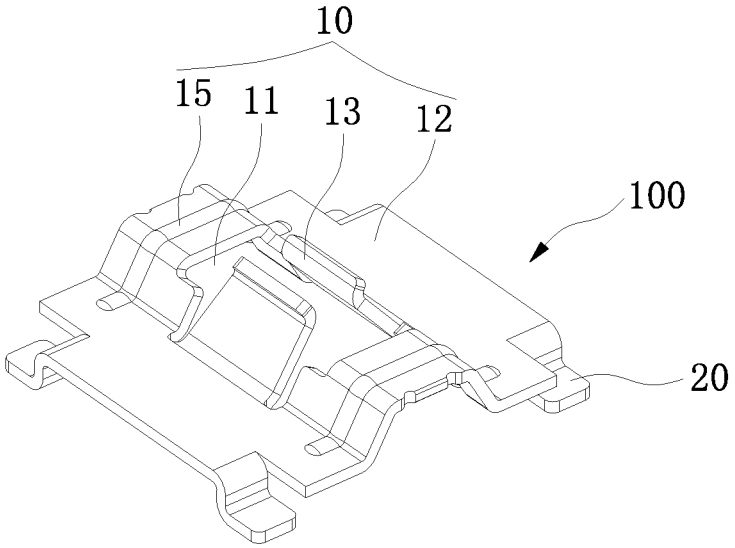
FIG. 6 is a perspective view in accordance with a second embodiment of the present invention.
Figure 7:
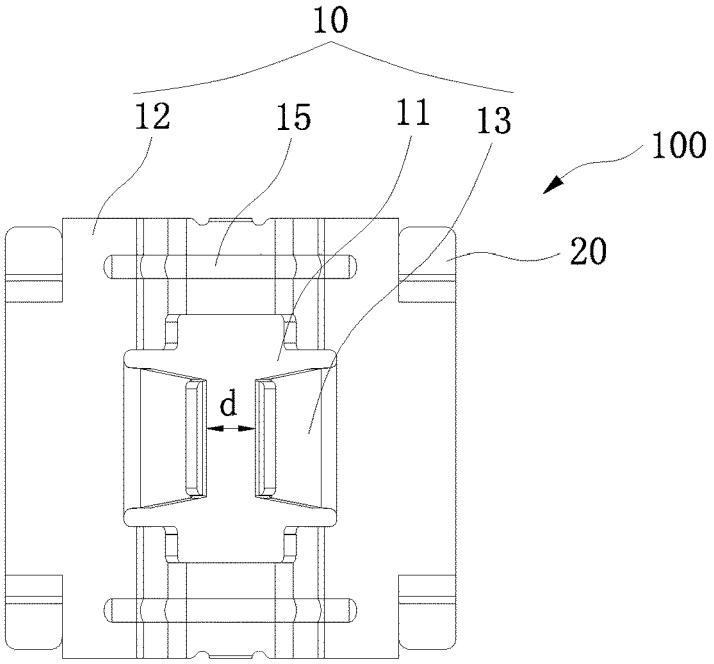
FIG. 7 is a top view in accordance with the second embodiment of the present invention.

The middle of the main body 10 is formed with an H-shaped cutout portion 11, so that the main body 10 is divided into a square frame 12 and two elastic pieces 13. Two first opposing sides of the square frame 12 are disconnected from the elastic pieces 13 and are erected upwardly. Specifically, the two first opposing sides of the square frame 12 have a reverse U shape. Furthermore, the two first opposing sides of the square frame 12 are provided with reinforcement ribs 15, respectively. The inner edges of two second opposing sides of the square frame 12 are connected with the lower ends of the two elastic pieces 13, respectively. The upper ends of the two elastic pieces 13 are inclined upwardly to form an elastic clip having an included angle $\alpha$ for insertion of a male terminal 200. As shown in FIG. 1 to FIG. 5, the upper ends of the two elastic pieces 13 are close to each other to form a guide hole 14 therebetween. The guide hole 14 is configured for insertion of the male terminal 200. As shown in FIG. 4, the male terminal 200 is a metal needle. As shown in FIG. 5, the male terminal 200 is a conducting wire having an insulating layer. As shown in FIG. 6 to FIG. 8, the upper ends of the two elastic pieces 13 have a gap defined therebetween and are bent reversely to extend upwardly. The gap d is configured for insertion of the male terminal 200 (PCB gold finger).

The outer ends (specifically, the outer ends of the two second opposing sides of the square frame 12) of the main body 10 are formed with the pins 20 for connection of a PCB board 300.

The present invention has a simple structure. Two opposing sides of the square frame 12 are erected upward, so that the two elastic pieces 13 are close to each other toward the middle of the square frame to form an elastic clip having an included angle α. This way ensures that the male terminal 200 (metal needle, conducting wire, or PCB gold finger) can be inserted well. The reliability of the electrical connection is better.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An integrated electrical connector, integrally formed of a sheet, comprising a main body, a middle of the main body being formed with an H-shaped cutout portion to divide the main body into a square frame and two elastic pieces, two first opposing sides of the square frame being disconnected from the elastic pieces and erected upwardly, inner edges of two second opposing sides of the square frame being connected with lower ends of the two elastic pieces respectively, such that the erection of the first opposing sides of the square frame brings the two elastic pieces of which the lower ends are connected with the second opposing sides of the square frame in directions toward a middle of the square frame and upper ends of the two elastic pieces are inclined toward each other in a direction away from the square frame to form an elastic clip having an included angle defined between the inclined elastic pieces for insertion of a male terminal, outer ends of the main body being formed with pins for connection of a printed circuit board (PCB).

2. The integrated electrical connector as claimed in claim 1, wherein the upper ends of the two elastic pieces are close to each other to form a guide hole therebetween, and the guide hole is configured for insertion of the male terminal that is a metal needle.

3. The integrated electrical connector as claimed in claim 1, wherein the upper ends of the two elastic pieces have a gap defined therebetween and are bent reversely to extend upwardly, and the gap is configured for insertion of the male terminal that is a PCB gold finger.

4. The integrated electrical connector as claimed in claim 1, wherein the two first opposing sides of the square frame are provided with reinforcement ribs, respectively.

5. The integrated electrical connector as claimed in claim 1, wherein the two first opposing sides of the square frame have a reverse U shape.

6. The integrated electrical connector as claimed in claim 1, wherein outer ends of the two second opposing sides of the square frame of the main body are formed with the pins for connection of the printed circuit board.

* * * * *